US005785170A

United States Patent [19]

Hammett

[11] Patent Number: 5,785,170

[45] Date of Patent: Jul. 28, 1998

[54] BEVERAGE CAN TRAY WITH IMPROVED HANDLING FEATURES

[75] Inventor: Roy Hammett, Odessa, Fla.

[73] Assignee: International Container Systems, Inc., Tampa, Fla.

[21] Appl. No.: 889,267

[22] Filed: Jul. 8, 1997

Related U.S. Application Data

[63] Continuation of Ser. No. 590,146, Jan. 23, 1996, abandoned.

[51] Int. Cl.[6] ..... B65D 75/00

[52] U.S. Cl. ..... 206/203; 206/509; 220/516

[58] Field of Search ..... 206/203, 139, 206/427, 505, 509; 220/509, 512, 515, 516, 517, 519

[56] References Cited

U.S. PATENT DOCUMENTS

| | | | |
|---|---|---|---|
| D. 208,111 | 7/1967 | Vidal . | |
| D. 317,670 | 6/1991 | Apps . | |
| D. 322,917 | 1/1992 | Morris et al. . | |
| D. 329,932 | 9/1992 | Apps . | |
| D. 330,621 | 10/1992 | Apps . | |
| D. 347,722 | 6/1994 | Apps . | |
| 2,215,252 | 9/1940 | Randall et al. . | |
| 2,965,226 | 12/1960 | Ettlinger et al. . | |
| 3,009,579 | 11/1961 | Ettlinger et al. . | |
| 3,092,284 | 6/1963 | Stout . | |
| 3,151,762 | 10/1964 | Vidal . | |
| 3,155,268 | 11/1964 | Fogerty et al. . | |
| 3,333,727 | 8/1967 | Belcher et al. . | |
| 3,334,767 | 8/1967 | Corneleus et al. . | |
| 3,349,943 | 10/1967 | Box . | |
| 3,351,264 | 11/1967 | Bostrom . | |
| 3,369,659 | 2/1968 | Ettlinger, Jr. . | |
| 3,391,814 | 7/1968 | Box . | |
| 3,391,815 | 7/1968 | Box . | |
| 3,638,824 | 2/1972 | Sekiguchi et al. . | |
| 3,791,549 | 2/1974 | Delbrouck et al. . | |
| 4,161,259 | 7/1979 | Palafox . | |
| 4,162,738 | 7/1979 | Wright . | |
| 4,204,617 | 5/1980 | Hirota . | |
| 4,319,685 | 3/1982 | David . | |
| 4,373,627 | 2/1983 | Wood | 206/203 |
| 4,410,099 | 10/1983 | De Larosiere . | |
| 4,615,444 | 10/1986 | De Larosiere . | |
| 4,625,908 | 12/1986 | Emery . | |
| 4,700,836 | 10/1987 | Hammett . | |

(List continued on next page.)

FOREIGN PATENT DOCUMENTS

| | | |
|---|---|---|
| 1474782 | 3/1967 | France . |
| 1152038 | 5/1969 | United Kingdom . |
| 1197058 | 1/1970 | United Kingdom . |
| 1330778 | 9/1973 | United Kingdom . |
| 2032886 | 5/1980 | United Kingdom . |
| WO 91/17097 | 11/1991 | WIPO . |

*Primary Examiner*—Paul T. Sewell
*Assistant Examiner*—Nhan T. Lam
*Attorney, Agent, or Firm*—Dennis H. Lambert

[57] ABSTRACT

A beverage can tray floor has a plurality of redoubts on its bottom surface for cooperation with the rims of cans in a sub-adjacent tray to impede free sliding movement of an upper tray over the rims of cans in a sub-adjacent tray, while enabling the upper tray to be slid over the cans in the lower tray. The redoubts include at least one elongate, tapered redoubt that extends in spanning relationship to the rim of a can to facilitate initial lateral sliding movement. The tray also has peripheral heel protector bands extending around a bottom portion thereof to protect the heels of cans, and upstanding can spacer members between can seating areas to maintain cans in the tray spaced from one another and prevent displacement of the cans from their seating areas when the tray is tilted. The sidewall includes a plurality of spaced pillars extending upwardly from the floor and supporting a peripheral top rail. The pillars are omitted and/or shortened in some areas to provide smooth, uninterrupted portions of the top rail which serve as handles. Spaces are defined between the upper ends of at least some of the pillars and the top rail, and upwardly projecting tabs on the upper ends of some of the pillars extend into the spaces when the trays are stacked to prevent wedging of the trays.

34 Claims, 15 Drawing Sheets

U.S. PATENT DOCUMENTS

| | | | |
|---|---|---|---|
| 4,700,837 | 10/1987 | Hammett . | |
| 4,789,063 | 12/1988 | Hammett . | |
| 4,834,243 | 5/1989 | Langenbeck . | |
| 4,899,874 | 2/1990 | Apps et al. . | |
| 4,928,841 | 5/1990 | Arthurs | 220/516 |
| 4,932,532 | 6/1990 | Apps et al. | 220/519 |
| 4,944,400 | 7/1990 | Van Onstein et al. . | |
| 5,031,761 | 7/1991 | De Larosiere . | |
| 5,031,774 | 7/1991 | Morris et al. | 206/427 |
| 5,060,819 | 10/1991 | Apps | 220/516 |
| 5,105,948 | 4/1992 | Morris et al. . | |
| 5,115,937 | 5/1992 | Chausse et al. | 206/203 |
| 5,184,748 | 2/1993 | Apps | 220/516 |
| 5,188,233 | 2/1993 | Hammett . | |
| 5,230,601 | 7/1993 | Apps et al. . | |
| 5,277,316 | 1/1994 | Apps et al. . | |
| 5,285,899 | 2/1994 | Apps et al. . | |
| 5,287,966 | 2/1994 | Stahl | 206/509 |
| 5,305,884 | 4/1994 | Apps et al. | 220/509 |
| 5,316,172 | 5/1994 | Apps et al. | 220/519 |
| 5,405,042 | 4/1995 | Apps et al. | 206/203 |
| 5,487,487 | 1/1996 | Hammett | 220/509 |
| 5,495,945 | 3/1996 | Apps et al. | 220/516 |
| 5,501,352 | 3/1996 | Apps | 220/509 |
| B1 4,344,530 | 3/1988 | De Larosiere . | |

FIG. 7
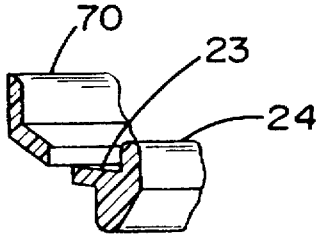
FIG. 8
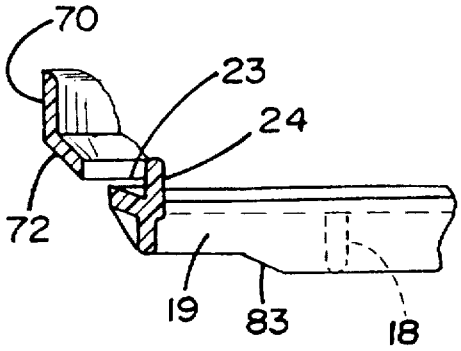
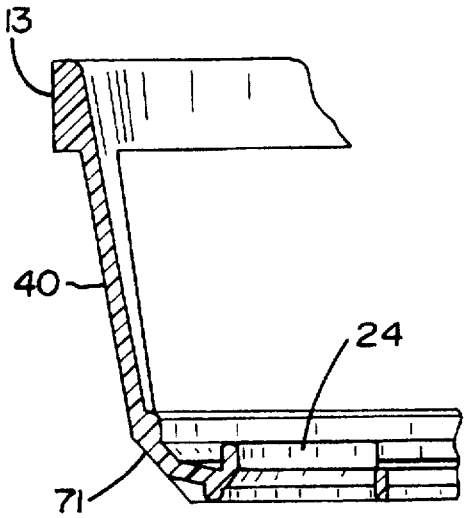
FIG. 9
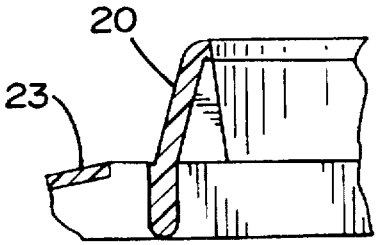
FIG. 10

FIG. 28
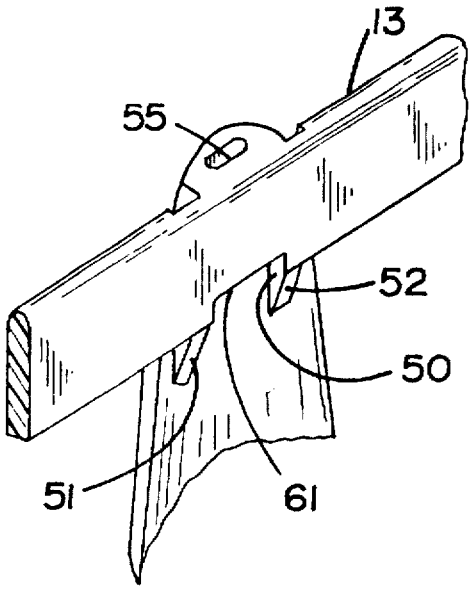
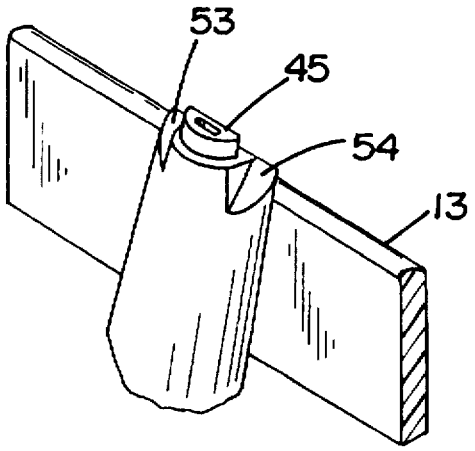
FIG. 27

BEVERAGE CAN TRAY WITH IMPROVED HANDLING FEATURES

This application is a Continuation of application Ser. No. 08/590146, filed Jan. 23, 1996 abandoned.

BACKGROUND OF THE INVENTION

1. Technical Field

This invention relates to packaging, and more particularly to packaging for containers such as cans of beverage. Specifically, the invention relates to a tray for holding cans of beverage during storage, shipment and handling.

2. Prior Art

Beverages, e.g., beer and soft drinks, are commonly packaged in cans or bottles. These cans and bottles, especially in sizes up to about sixteen ounces, are frequently bundled in groups of six, eight or twelve cans or bottles for marketing to consumers. To facilitate handling, whether bundled together in pre-packaged groups or left loose, the cans and bottles are typically packaged in cartons or trays holding from four to twenty-four containers of beverage, depending upon the size of the containers.

Reusable molded plastic trays have been developed for cans, especially, to support the cans in groups of twenty-four for ease of handling during storage and shipment. These prior art trays have structure on their bottom surface to enable a plurality of trays filled with cans of beverage to be stably stacked. This bottom structure also provides for lateral sliding movement of a tray across the tops of cans supported in a lower tray, when it is desired to remove a tray from the stack. Features are also provided in prior art trays to enable nestable stacking of empty trays without shingling or wedging together of the trays.

Conventional beverage can trays are typically of low depth construction and have an inner bottom surface that defines a plurality of can seating areas on which cans of beverage are supported, and generally include a side wall or top rail spaced from the bottom of the tray and which defines the outer perimeter and top of the tray. In conventional trays, this top rail is typically spaced about two inches or less from the bottom of the tray. Moreover, in trays having the top rail supported from the bottom by spaced pillars, bottom portions of some of the cans are exposed through the side of the tray and are susceptible to being damaged during hand-cart or forklift handling of the trays. Further, the top surface of a conventional tray bottom is generally relatively flat. When a route driver is transferring cans from the tray into a vending machine, for example, the tray is typically held at a relatively steep angle, and the cans can shift and slide in the tray, thereby increasing the difficulty and time required to perform the task.

Conventional trays generally have downwardly projecting blocking members or redoubts on their bottom surface which extend either inside or outside the space bounded by the rims of cans in a sub-adjacent tray to prevent free lateral sliding movement of one tray relative to another, thereby enabling a plurality of loaded trays to be stacked together in stable relationship. However, the blocking members or redoubts are configured to enable the trays to be slid relative to one another so that a tray can be slid laterally and removed from the stack, when desired. Nonetheless, the redoubts on conventional trays are generally located either inside or outside the space bounded by the rim of a can, thereby resulting in a detent between the redoubts and the can rim which must initially be overcome before one tray can be slid relative to another. This is usually accomplished by first twisting one tray relative to a sub-adjacent tray to bring the redoubts of that tray up onto the rims of the cans in the sub-adjacent tray so that the top tray can be slid laterally on the tops of the cans in the bottom tray.

Further, route drivers generally handle the trays by grasping the top rail in one or both hands. Most conventional trays do not provide any handle means to facilitate grasping of the rail by a route driver, and handling of the tray can be awkward or uncomfortable because of contact with projections on the trays that facilitate nestable stacking of empty trays, and/or because of contact with the pillars which support the rail from the bottom. Moreover, conventional trays generally do not have any means to facilitate entry of a finger of fingers beneath the tray bottom to facilitate lifting or movement of the tray.

Still further, conventional trays have low depth construction and this provides minimal stability to loose cans supported in the tray when the tray is bring handled, especially when the tray is tilted at an angle.

Accordingly, there is need for a beverage can tray having means for overcoming one or more of the above-described shortcomings of conventional beverage can trays.

SUMMARY OF THE INVENTION

The beverage can tray of the present invention is a mid-depth, economical, molded plastic tray that has features which overcome the disadvantages associated with conventional beverage can trays, as discussed above. To this end, the tray of the invention includes uniquely configured redoubts on the bottom surface that include portions which extend in spanning relationship to the rims of cans in a sub-adjacent tray to enable stable stacking of trays while at the same time facilitating lateral movement of a tray across the tops of cans in a sub-adjacent tray.

The tray of the invention also includes heel protector means extending around the outer periphery of the bottom of the tray to prevent damage to the bottom ends of cans supported therein during handling of the tray.

Moreover, the tray of the invention includes unobstructed handle means which facilitates the comfort and ease of handling of the tray when it is grasped by a route driver or other person.

In addition, upwardly projecting spared means are provided on the upper surface of the bottom of the tray which maintains loose cans therein in spaced relationship to one another and prevents their free sliding movement across the bottom of the tray when the tray is partially empty and is tilted to an inclined position.

Further, the tray of the invention includes spaced means which provides a more stable columnar stack when multiple empty trays are stacked together, and has interengaging means at the top rail and pillars when the trays are stacked to provide even further stability and prevent fraying of the top rail.

Additionally, the side wall height of the tray of the invention is greater than conventional trays to provide greater stability for loose cans during handling while at the same time providing UPC label visibility on most major brands of beverage cans.

The foregoing and other advantages are provided in a tray that is economical to produce and which greatly facilitates the handling of the trays and cans during use. These advantages are achieved by a molded plastic tray having a bottom with a top surface and a bottom surface. The top surface is subdivided into a plurality, e.g., twenty-four, of can seating areas or pockets, with upstanding can spacers or supports distributed across the top surface between the can seating areas. In a preferred construction, the the corners of the bottom are higher than the remaining projections to define the spaced means noted above which provide a more stable columnar stack of the trays when nested together.

The uniquely configured redoubts and strut members of the invention have portions projecting below the bottom surface of the tray for cooperative engagement with the rims of cans in a sub-adjacent tray to provide stability to a stack of trays, while at the same time enabling the trays to be relatively easily moved laterally with respect to one another. This is accomplished by providing the redoubts and struts with members which extend in spanning relationship to the rims of cans in a sub-adjacent tray to facilitate lateral sliding movement of the tray across the tops of cans in a sub-adjacent tray, but which includes portions of different elevation to enable stable stacking of loaded trays on top of one another. The portions of different elevation also include recessed areas at locations where the struts and redoubts cross, providing clearance for the pull tabs on cans in a sub-adjacent tray.

Further, the redoubts and struts are configured to provide substantially coplanar contact surfaces across the length and width of the tray so that the tray will not become hung up on rollers of conveyor systems and the like.

The heel protector means comprises relatively narrow, arcuately shaped upright bands or walls extending between the pillars at their base ends, defining a generally serpentine, continuous wall around substantially the entire outer periphery of the tray to protect the heels of cans supported in the tray from damage due to contact with the blade of a hand truck or fork lift and the like. This heel protector is normally spaced from the heel of the can so that impact against the heel protector is not transferred into the wall of the can, thereby damaging it.

The handle means in the tray of the invention are formed by terminating the center pillar along each long side of the tray at the bottom edge of the top rail. This unobstructed area improves the ergonomics of the tray by providing a smooth section to be grasped by a person handling the tray. Further, termination of the pillar in this way also eliminates sink marks in the flat outer surface of the rail at this location, thereby providing a relatively smooth, unobstructed area for placement of a company logo or other graphics.

Handle means at the ends of the tray are similarly provided by omitting the center pillar at each end, leaving a free, unobstructed rail portion to serve as a handle.

The side wall height of the tray of the invention is approximately one inch greater than the side wall height of conventional low depth trays, e.g., about 2⅞ inches as compared with about 2 inches, to lend greater stability to cans supported in the tray, especially when the tray is held at a steep angle. In spite of its greater side wall height, the tray of the invention nests very compactly, with each tray occupying a vertical distance of only the width of the top rail, e.g., about 7/10 of an inch.

The tray of the invention thus overcomes many, if not all, of the shortcomings of conventional trays, and in addition provides other features and advantages not found in prior art trays.

BRIEF DESCRIPTION OF THE DRAWINGS

The foregoing, as well as other objects and advantages of the invention, will become apparent from the following detailed description when considered in conjunction with the accompanying drawings, wherein like reference characters designate like parts throughout the several views, and wherein:

FIG. 7 is an enlarged fragmentary sectional view taken along line 7—7 in FIG. 6;

FIG. 8 is an enlarged fragmentary sectional view taken along line 8—8 in FIG. 6;

FIG. 9 is an enlarged fragmentary sectional view taken along line 9—9 in FIG. 6;

FIG. 10 is an enlarged fragmentary sectional view taken along line 10—10 in FIG. 6;

FIG. 27 is an enlarged fragmentary perspective view of a portion of a pillar and top rail, showing the angled webs and cooperative notches for secure, compact nesting engagement of the trays and to prevent shingling and/or wedging of the trays when they are nested in stacked relationship with one another;

FIG. 28 is an enlarged fragmentary perspective view of a portion of the top rail and an associated pillar, showing the cut-out provided for engagement with a tool to remove the tray during the hot-stamping process.

DETAILED DESCRIPTION OF THE PREFERRED EMBODIMENTS

Figure 1:
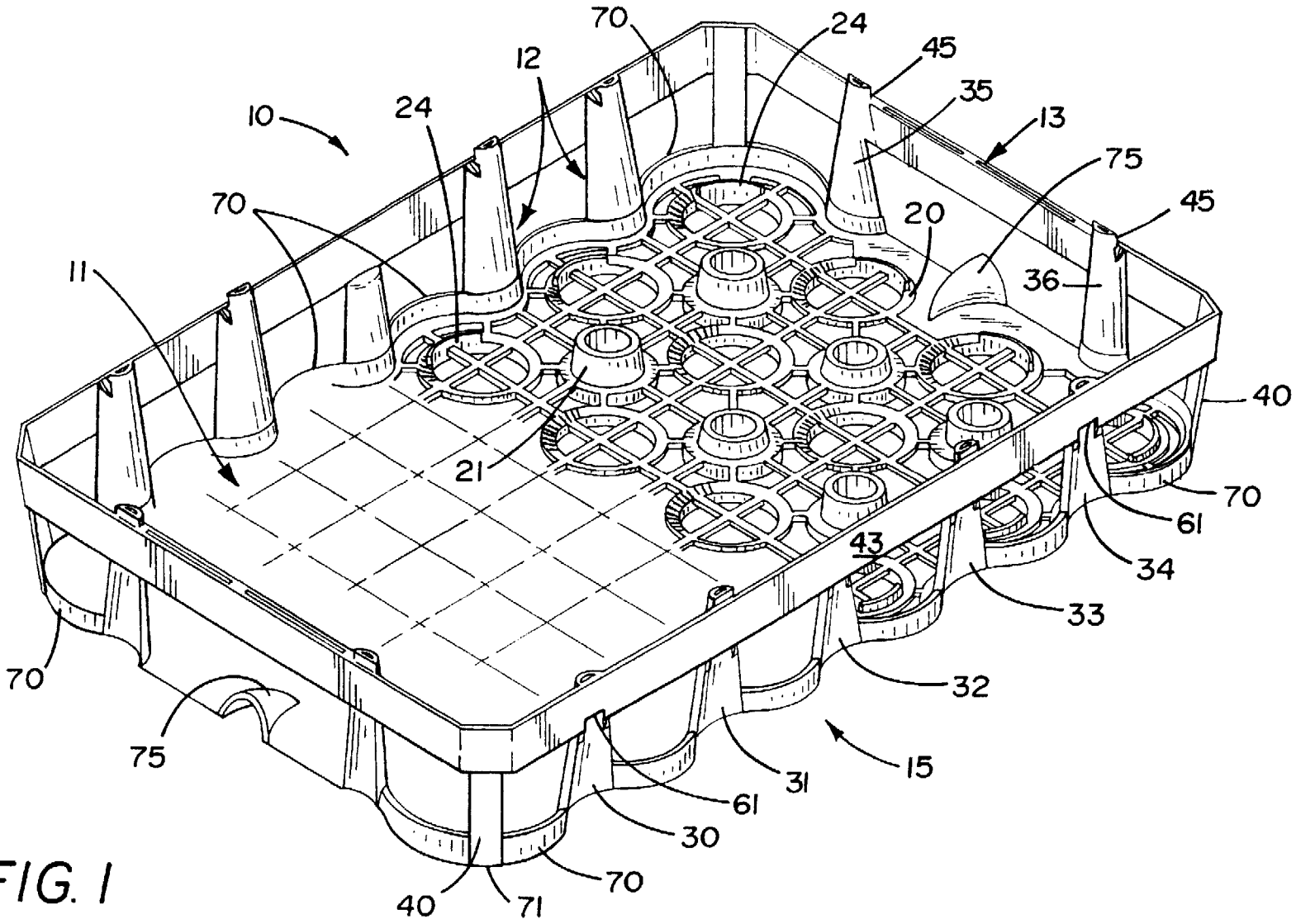
FIG. 1 is a top perspective view of the beverage can tray according to the invention.
Figure 2A:
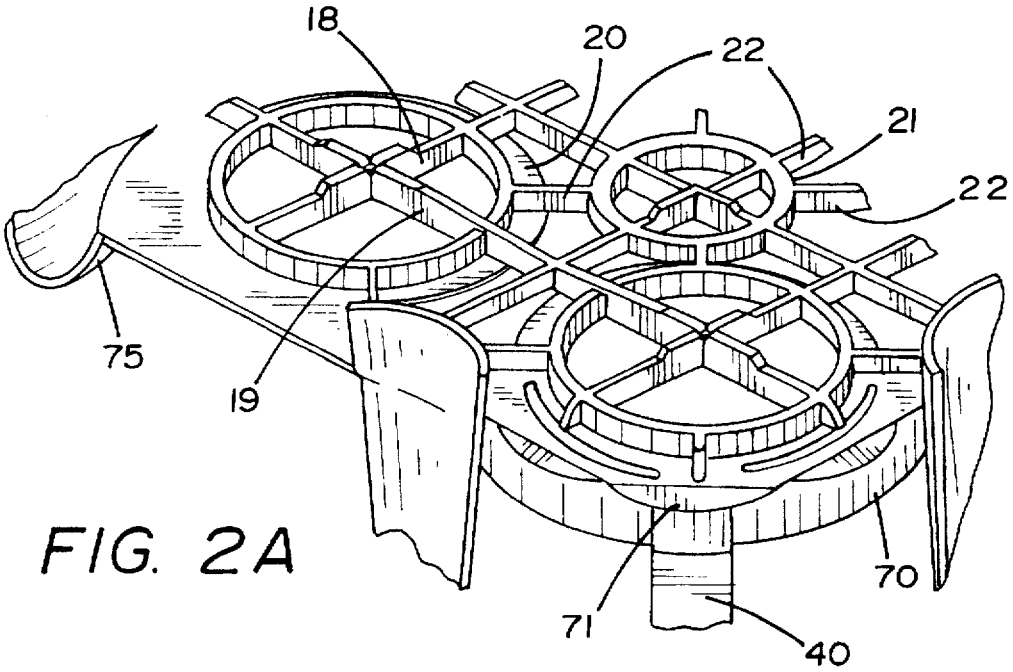
FIG. 2A is an enlarged, fragmentary, bottom perspective view of the near corner portion of the tray, as viewed in FIG. 2.
Figure 2:
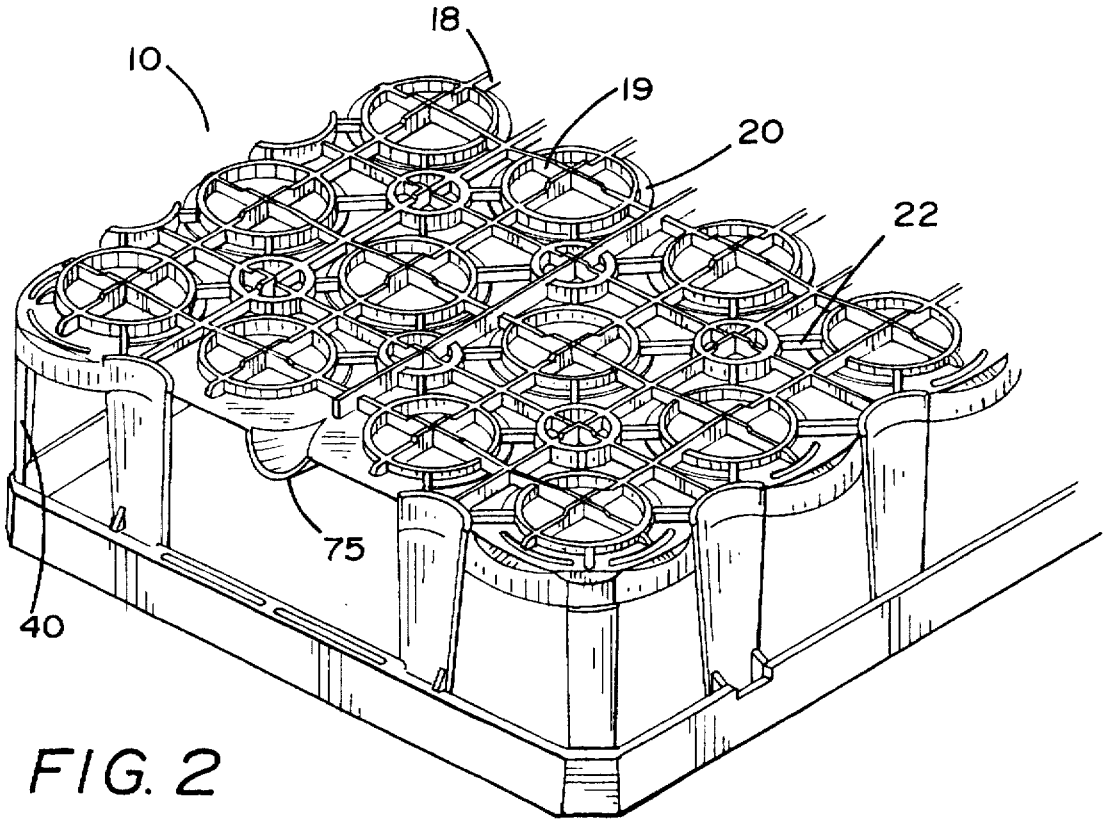
FIG. 2 is a bottom perspective view thereof.
Figure 3:
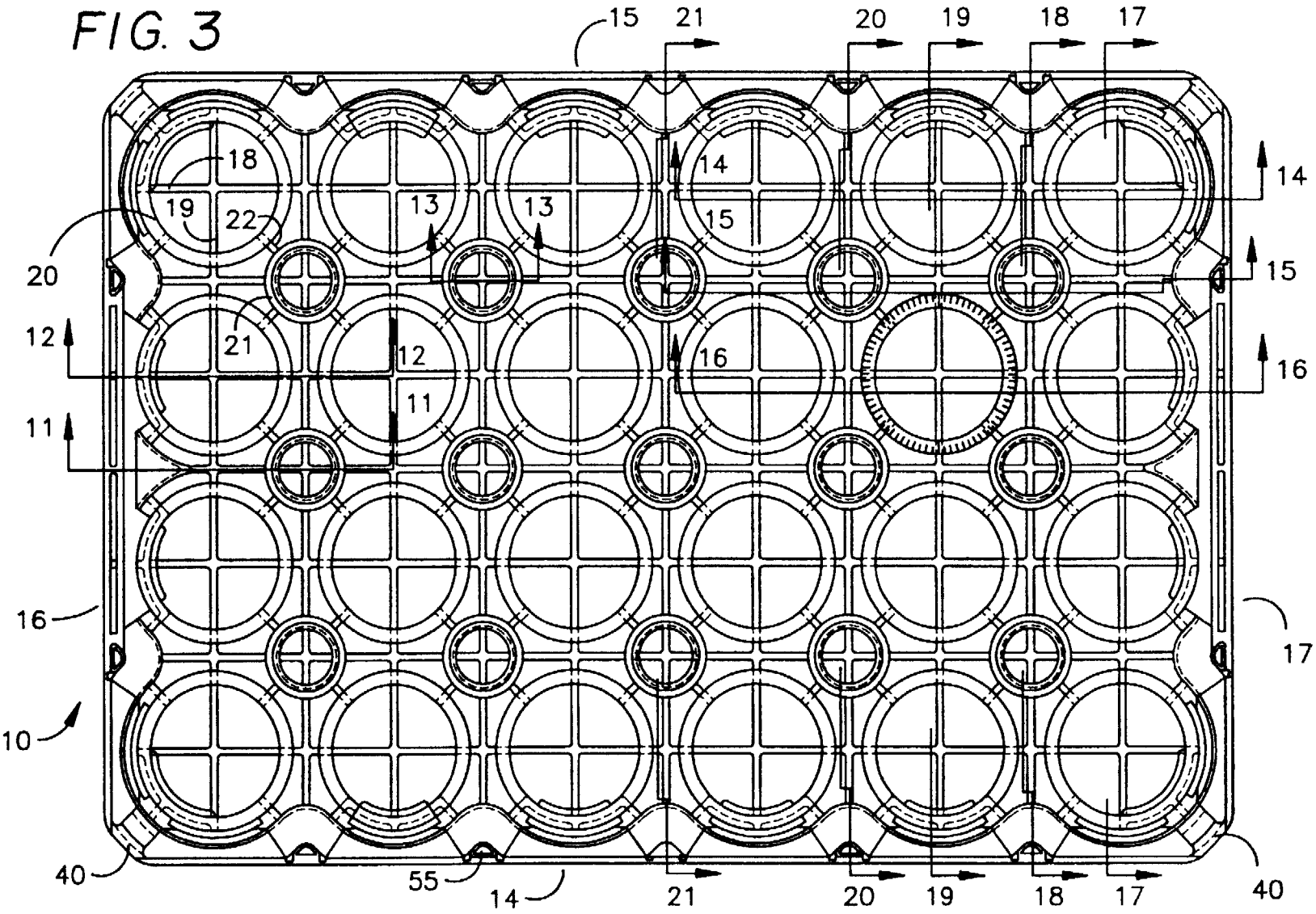
FIG. 3 is a top plan view thereof.
Figure 4:
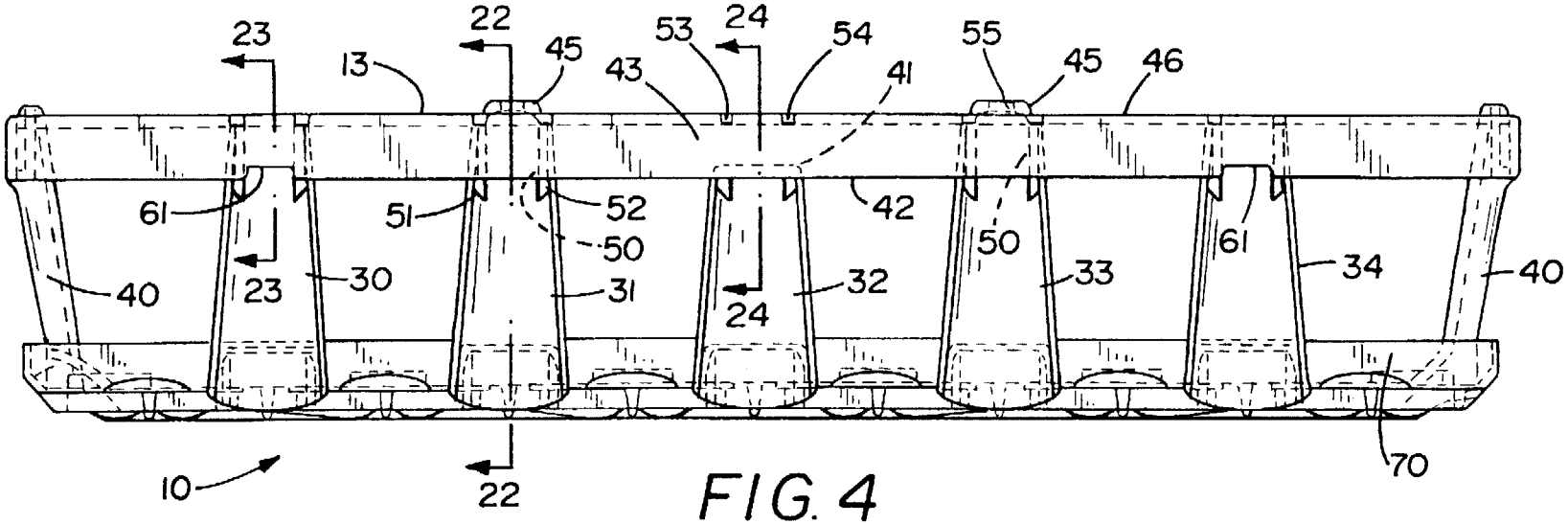
FIG. 4 is a side view in elevation thereof.
Figure 5:
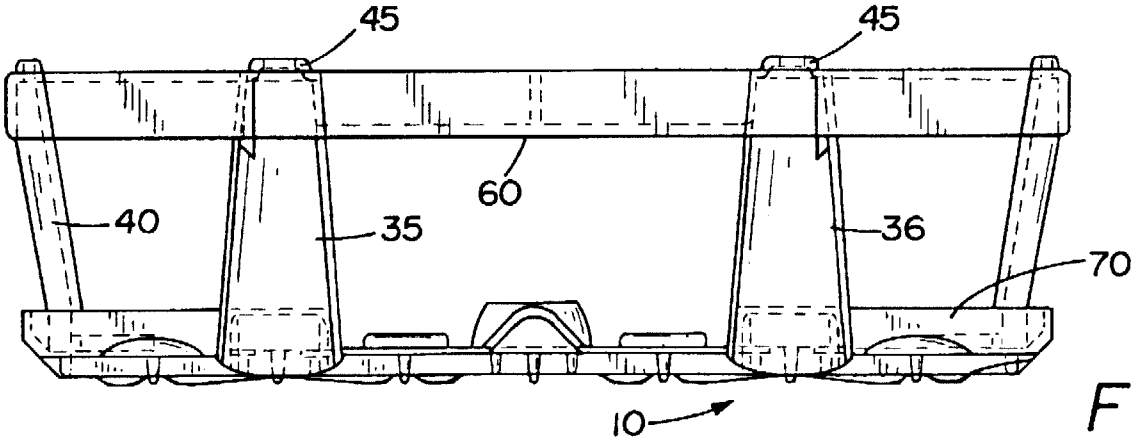
FIG. 5 is an end view in elevation thereof.
Figure 6:
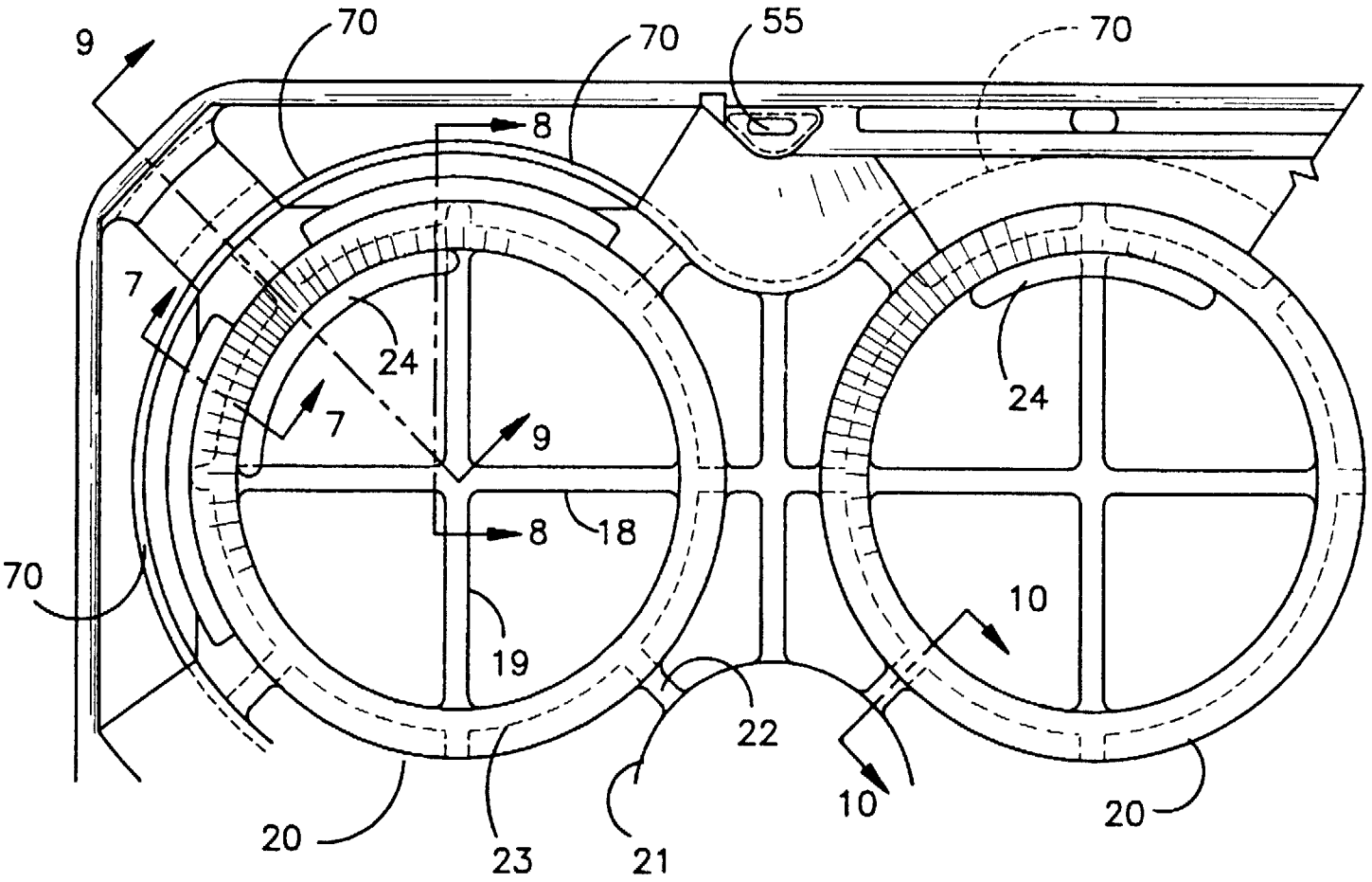
FIG. 6 is a greatly enlarged fragmentary plan view of one corner portion thereof.
Figure 12:
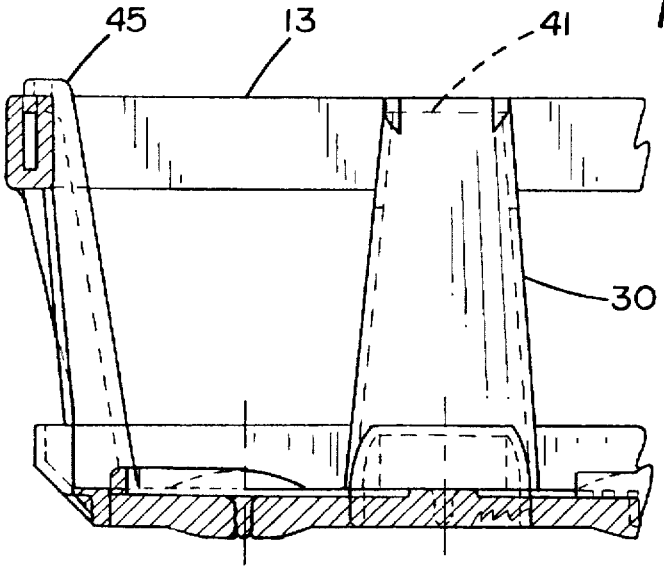
FIG. 12 is an enlarged fragmentary sectional view taken along line 12—12 in FIG. 3.
Figure 11:
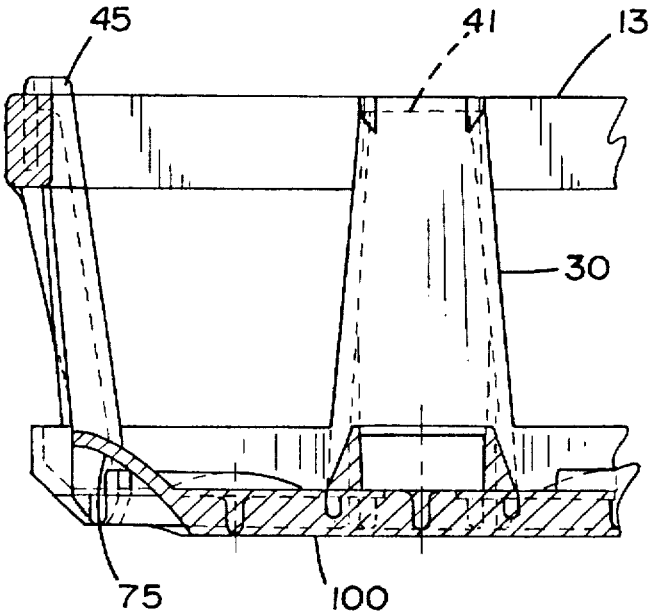
FIG. 11 is an enlarged fragmentary sectional view taken along line 11—11 in FIG. 3.
Figure 13:
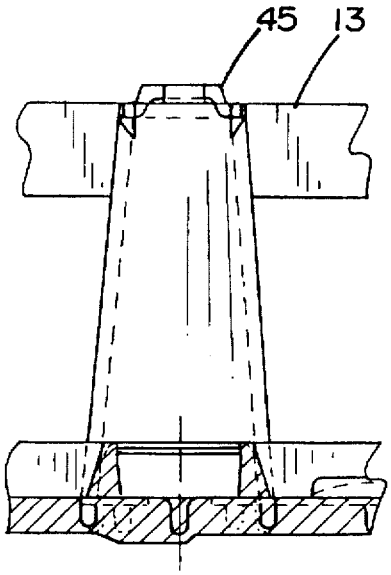
FIG. 13 is an enlarged fragmentary sectional view taken along line 13—13 in FIG. 3.
Figure 14:
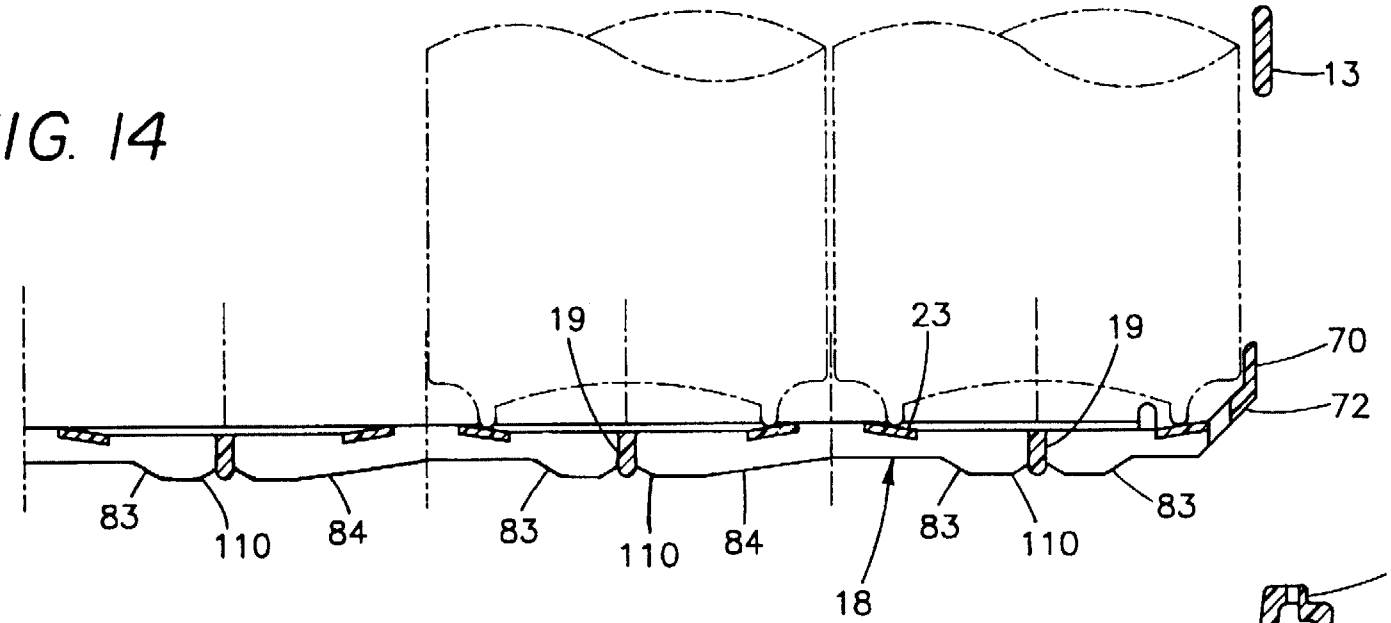
FIG. 14 is a slightly enlarged fragmentary sectional view taken along line 14—14 in FIG. 3.
Figure 15:
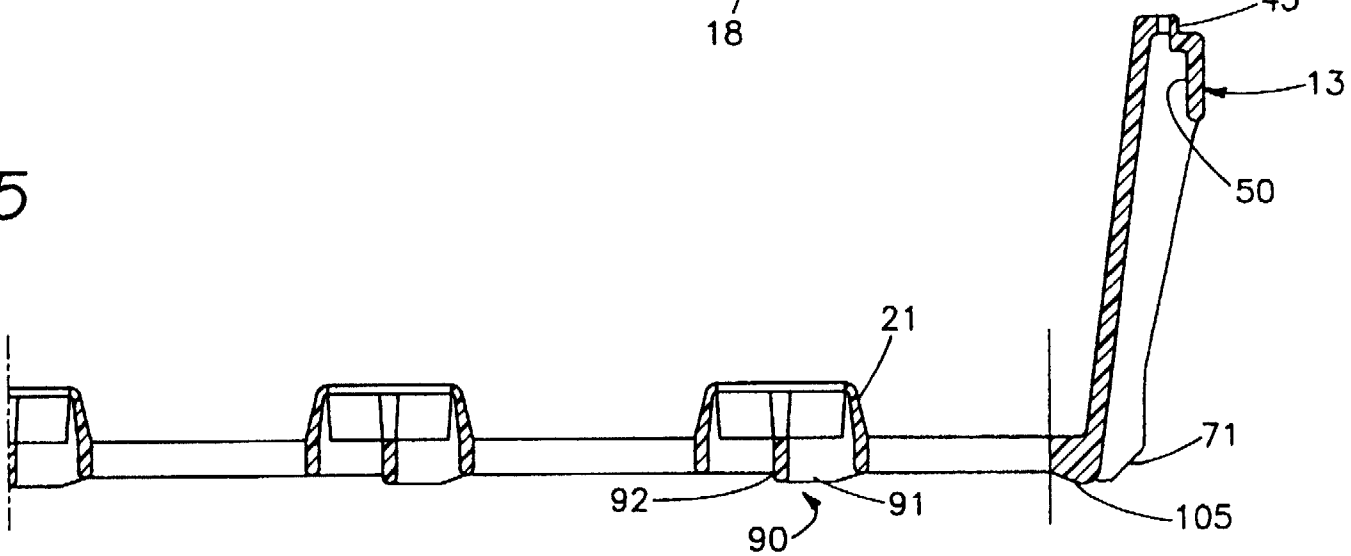
FIG. 15 is a slightly enlarged fragmentary sectional view taken along line 15—15 in FIG. 3.
Figure 16:
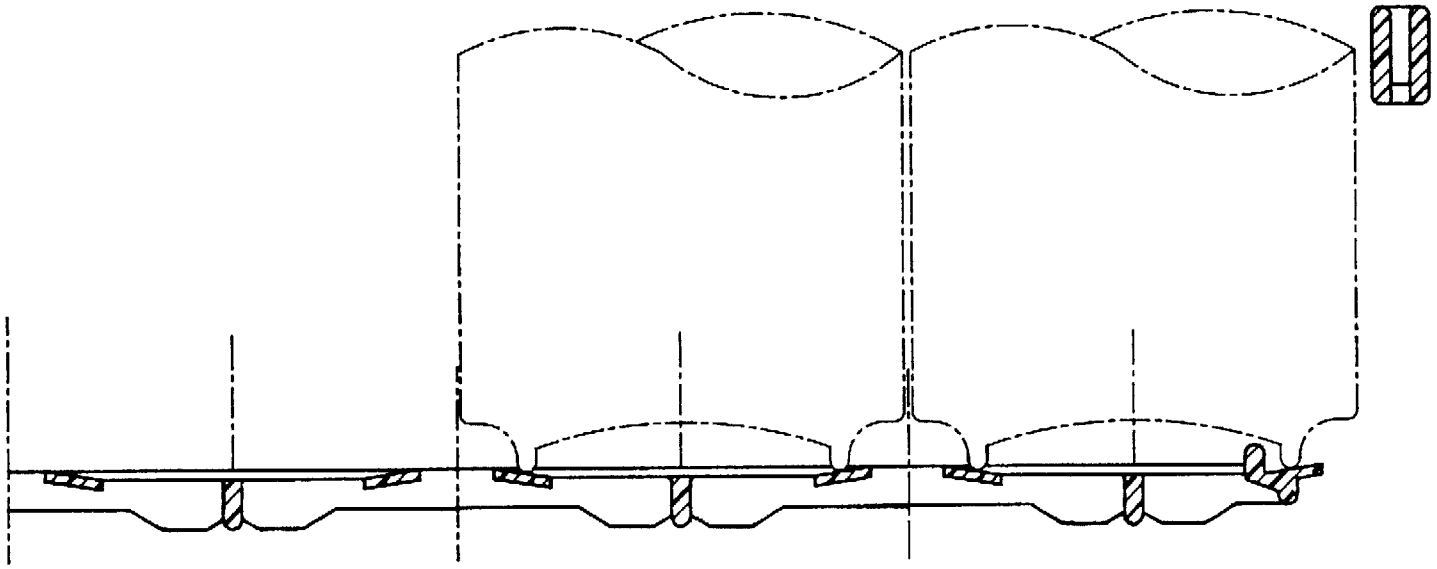
FIG. 16 is a slightly enlarged fragmentary sectional view taken along line 16—16 in FIG. 3.
Figure 17:
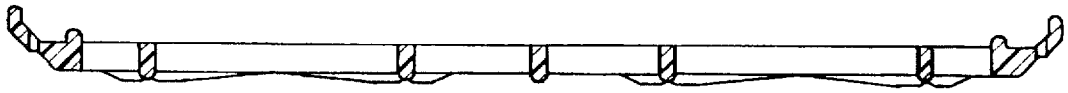
FIG. 17 is a transverse sectional view taken along line 17—17 in FIG. 3.
Figure 18:
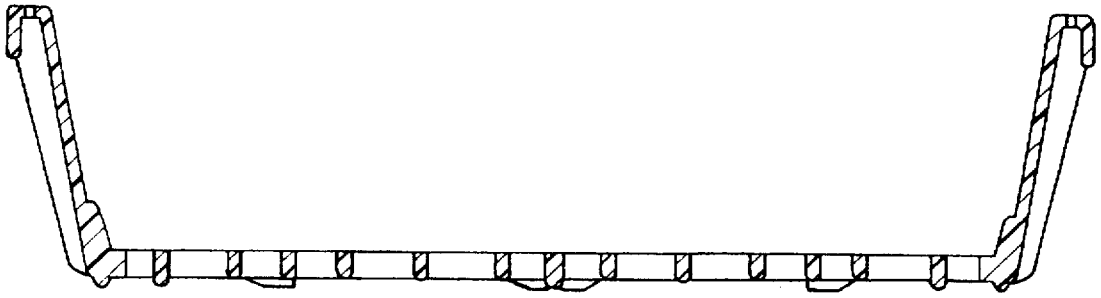
FIG. 18 is a transverse sectional view taken along line 18—18 in FIG. 3.
Figure 19:
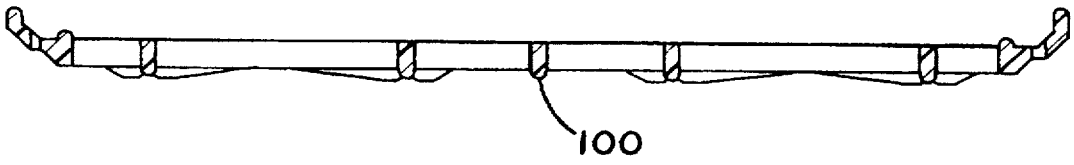
FIG. 19 is a transverse sectional view taken along line 19—19 in FIG. 3.
Figure 20:
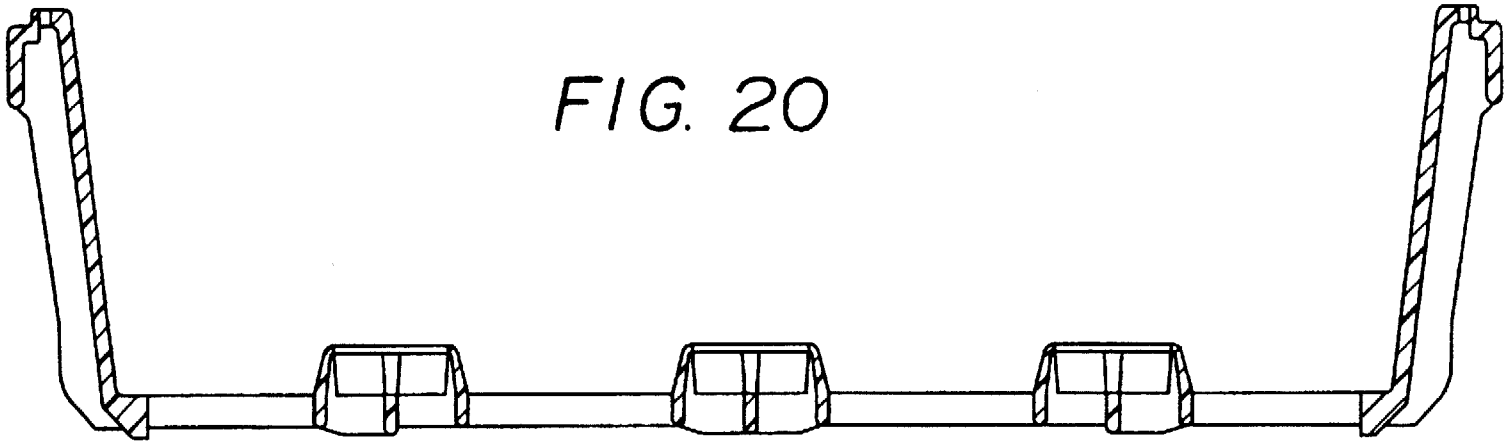
FIG. 20 is a transverse sectional view taken along line 20—20 in FIG. 3.
Figure 21:
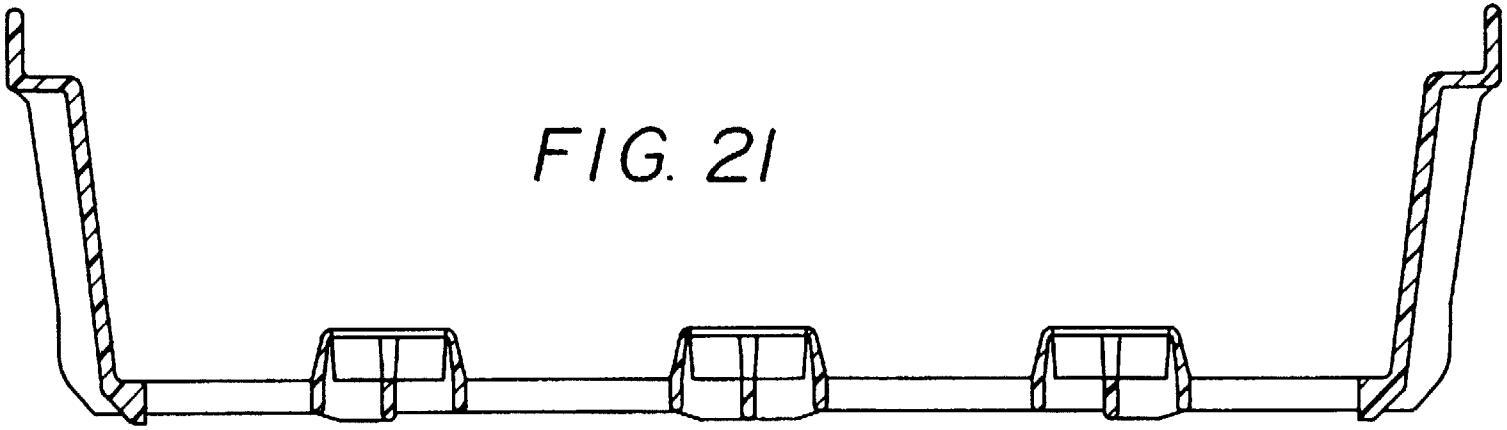
FIG. 21 is a transverse sectional view taken along line 21—21 in FIG. 3.
Figure 26:
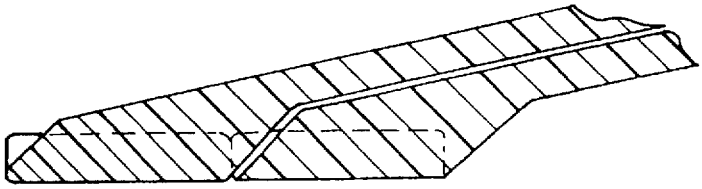
FIG. 26 is an enlarged fragmentary sectional view taken on line 26—26 in FIG. 25.

A preferred embodiment of the can tray of the present invention is indicated generally at 10 in FIGS. 1–5. The tray comprises a bottom 11 having a plurality of spaced apart upstanding pillars 12 about its periphery, supporting a top rail 13 at their upper ends. In the construction shown, the tray has two long sides 14 and 15 and two shorter sides or ends 16 and 17, with a width to length relationship of 2:3, and adapted to hold four cans across its width and six cans along its length, for a total of twenty-four cans. It should be understood, however, that the principles of the invention could be incorporated in trays having different dimensional relationships and capacities for holding different numbers of cans.

The floor 11 is formed by a plurality of parallel, uniformly spaced apart longitudinal struts 18 and a plurality of parallel, uniformly spaced apart transverse struts 19, intersecting the longitudinal struts at right angles thereto. The struts define an open grid-like structure that is lightweight and requires less material in the manufacture of the tray. Further, this open grid-like configuration provides drainage for any liquids or other debris that may fall into the tray.

The struts support a plurality (twenty-four) of circular can seating areas 20 distributed uniformly over the bottom of the tray, and a plurality of upwardly extending, generally frustoconically shaped spacer members 21 in locations between the can seating areas. The spacer members are also joined to the can seating areas by diagonal struts 22 extending between the bases of the spacer members and the undersides of adjacent portions of the circular can seating areas.

The circular can seating areas are each defined by a relatively narrow annular wall or seat 23 that is tapered downwardly toward its center so that cans placed on the circular seating area are automatically centered on the seat. The upper surface of the can seating area is relatively unobstructed, since the struts extend on the underside thereof. Each circular seating area is dimensioned for supporting contact with the rim on the bottom end of a can, and the side wall of the can extends outwardly into close proximity with the adjoining upwardly projected spacer members so that the cans are held in their respective seating areas even if the tray is disposed at a relatively steep angle of inclination. In other words, the sides of the cans will engage against the spacer members to prevent dislocation and sliding movement of the cans across the floor of the tray. Other than the angled circular can seating surfaces and the upwardly projecting spacer members, the top surface of the floor of the tray is relatively flat and unobstructed. It should be noted, however, that those can seating areas disposed around the outer periphery of the floor of the tray each has a relatively short, upstanding, arcuately shaped lip or flange 24 at the inner margin of the tapered seating surface and on the side of the seating area disposed outwardly toward the adjacent side of the tray. These arcuately shaped flanges serve to help retain cans in position on the seating areas as more fully described in applicant's earlier U.S. Pat. No. 5,188,233.

In the specific configuration described and illustrated herein, there are five upstanding pillars 30–34 spaced along each long side of the tray, not counting the corner posts 40 at the corners of the tray, and two upstanding pillars 35 and 36 spaced along each end of the tray. The pillars 30–36 are disposed on lines bisecting the space between adjacent rows of circular can seating areas, and are integrally joined at their base ends to the adjacent ends of struts extending along those lines. It will be noted that the struts to which the pillars are attached form the intersecting grid members which support the spacer members.

The pillars 30–36 are generally identically constructed, and each has an arcuately curved transverse cross-sectional shape, tapering to a wider base adjacent the floor of the tray and a narrower top at the rail. Further, the center pillar 32 along each long side of the tray terminates at its upper end 41 at the bottom edge 42 of the top rail, whereby the rail in this location is relatively smooth and unobstructed, enhancing the ergonomics of the tray by providing a smooth portion which may be grasped by a person handling the tray. Termination of the center pillar at the bottom edge of the top rail also eliminates any sink marks that might otherwise occur during manufacture of the tray, resulting in a smooth, flat, vertical outer surface 43 on the rail which is especially suited for receiving the logo of a company, or other graphics, as desired.

The two pillars 31 and 33 on either side of the center pillar extend upwardly across the width of the inner surface of the top rail, and have upwardly projecting tabs 45 on their upper ends extending beyond the top edge 46 of the rail. These tabs cooperate with the rail and concave side of the pillars when the trays are stacked together in nested relationship, as more fully described hereinafter.

The two endmost pillars 30 and 34 along each side extend upwardly at their upper ends along the inner surface of the top rail, but terminate essentially level with the top of the rail.

The two pillars 35 and 36 on each end of the tray also extend upwardly along the inner surface of the top rail, and have tabs 45 on their upper ends projecting upwardly beyond the top edge of the rail.

Figure 23:
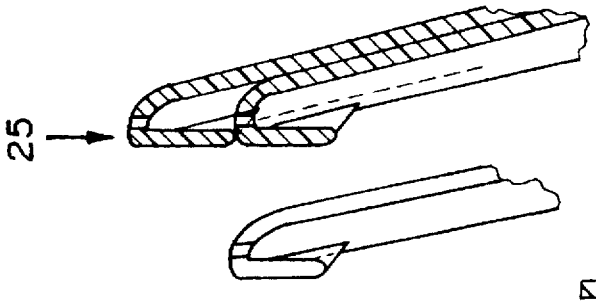
FIG. 23 is a fragmentary sectional view taken along line 23—23 in FIG. 4, but showing a pair of trays stacked together in nested relationship.
Figure 25:
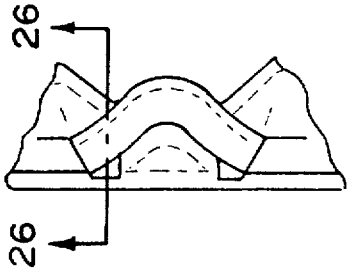
FIG. 25 is an enlarged fragmentary plan view taken on arrow 25 in FIG. 23.
Figure 24:
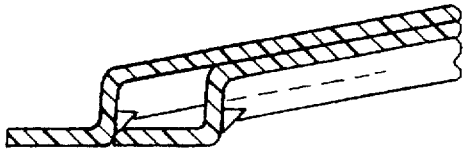
FIG. 24 is a fragmentary sectional view taken along line 24—24 in FIG. 4, but showing a pair of trays stacked together in nested relationship.
Figure 22:
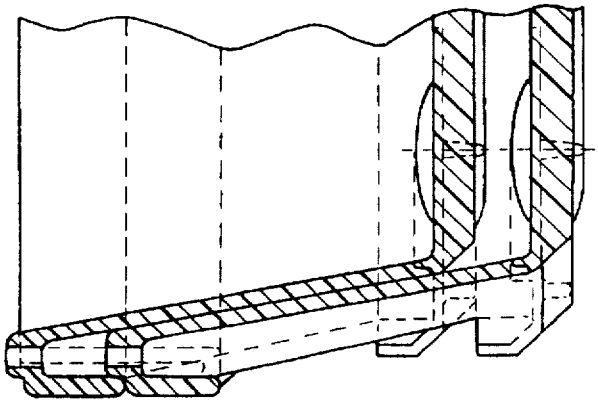
FIG. 22 is a fragmentary sectional view taken along 22—22 in FIG. 4, but showing a pair of trays stacked together in nested relationship.

Thus, when the trays are stacked together in nested relationship with one another (see FIGS. 22–24), the tabs on the opposite ends of each tray and at spaced locations along the opposite sides interengage with the rail on the superadjacent tray to prevent wedging of the trays. Thus, the previously described tabs 45 on the upper ends of the pillars 31, 33, 35 and 36 extend into the space 50 defined between the arcuately curved pillars and the generally vertically oriented wall of the top rail, assuring that the side walls of a sub-adjacent tray will not spread under the weight of a tray nested therein. This is especially important when a large number of trays are stacked together in nested relationship.

To prevent shingling of the trays, a pair of tapered ramps or webs 51 and 52 are formed at the upper end of each pillar and extend outwardly and upwardly from the concave side of the pillar at a position spaced below the bottom edge to the bottom edge of the rail. To prevent interference between these ramps and the top edge of a sub-adjacent rail in which a tray is stacked, the top edge of the rail is notched at 53 and 54 adjacent the upper end of each pillar in a position corresponding with the location of the ramps so that when the trays are nested the ramps lie in the these notches, thereby enabling deeper nesting of the trays.

In order to permit drainage of any water that might enter into the cavity formed between the concave surface of the pillars and the back surface of the rail, a small opening 55 is formed through the top of each pillar.

It will be observed that there is no pillar in the center of each end wall, leaving a relatively large unobstructed section of rail 60. Further, this section of rail is thicker than the remainder of the rail, forming a relatively comfortable handle for grasping and handling the tray.

Because the trays of the invention are able to nest very compactly, with the bottom edge of the top rail on an upper tray essentially engaged against the top edge of the rail on a lower tray due to the nesting structure described above, notches 61 are provided in the bottom edge of the rail at the locations of the endmost pillars 30 and 34 along each long side of the tray to enable automated equipment (not shown) to be used to remove the trays from a stack of trays during, e.g., the manufacturing process.

To prevent damage to the heels of cans disposed around the periphery of the tray, relatively narrow, arcuately shaped, upstanding bands or heel protectors 70 are joined to and extend between the base ends of adjacent pillars in circumferentially outwardly spaced relationship to the peripheral can seating areas. It will be noted that the directions of curvature of the pillars 30–36 and the heel protectors 70 are oppositely oriented, whereby a smoothly curved serpentine configuration results around the perimeter of the floor of the tray. The heel protectors are dimensioned so that they are spaced slightly outwardly from the base end of a can seated in the adjacent can seating area so that impacts against the heel protector are not transmitted directly into the can sidewall. The heel protector is especially beneficial when the trays are being handled with handcarts or forklifts.

To facilitate insertion of the blade of a handcart or the forks of a forklift beneath the tray of the invention, the base ends 71 of the pillars and the lower edge 72 of each heel protector is downwardly and inwardly tapered to provide a guide surface for guiding a lifting implement beneath the tray.

Further, to facilitate insertion of a finger or fingers beneath the ends of the tray during handling, upwardly curved recesses 75 are formed at the center of each end of the floor of the tray.

As seen best in FIGS. 2, 2*a* 14–21 and 29, downwardly projecting redoubt sets 80 are formed on the bottom edges of the struts in predetermined locations to form multi-level ramps extending below the bottom plane of the floor of the tray for cooperation with the top rims of cans in a sub-adjacent tray when a plurality of loaded trays are stacked on top of one another to prevent free lateral movement of one tray relative to the other, enabling the trays to be stably stacked together. At the same time, the redoubts should permit the trays to be moved or slid laterally over one another, when desired, so that a tray can be slid off of the stack without having to first lift it vertically away from the stack. The redoubt sets each comprise orthogonally disposed, downward projections 81 and 82 on the underside of the laterally and longitudinally extending struts, respectively, beneath the can seating areas, with the projections intersecting one another at right angles at a point aligned substantially with the center of each can seating area. Opposite ends of the redoubts are tapered at 83 to facilitate movement over the rim of a can, and at least one downward projection 84 in each set is longer than the other redoubts in that set and extends beyond the rim of a can so that when the trays are stacked on top of one another this longer redoubt spans the rim of the can, facilitating initial lateral movement of one tray relative to another.

Figure 29:
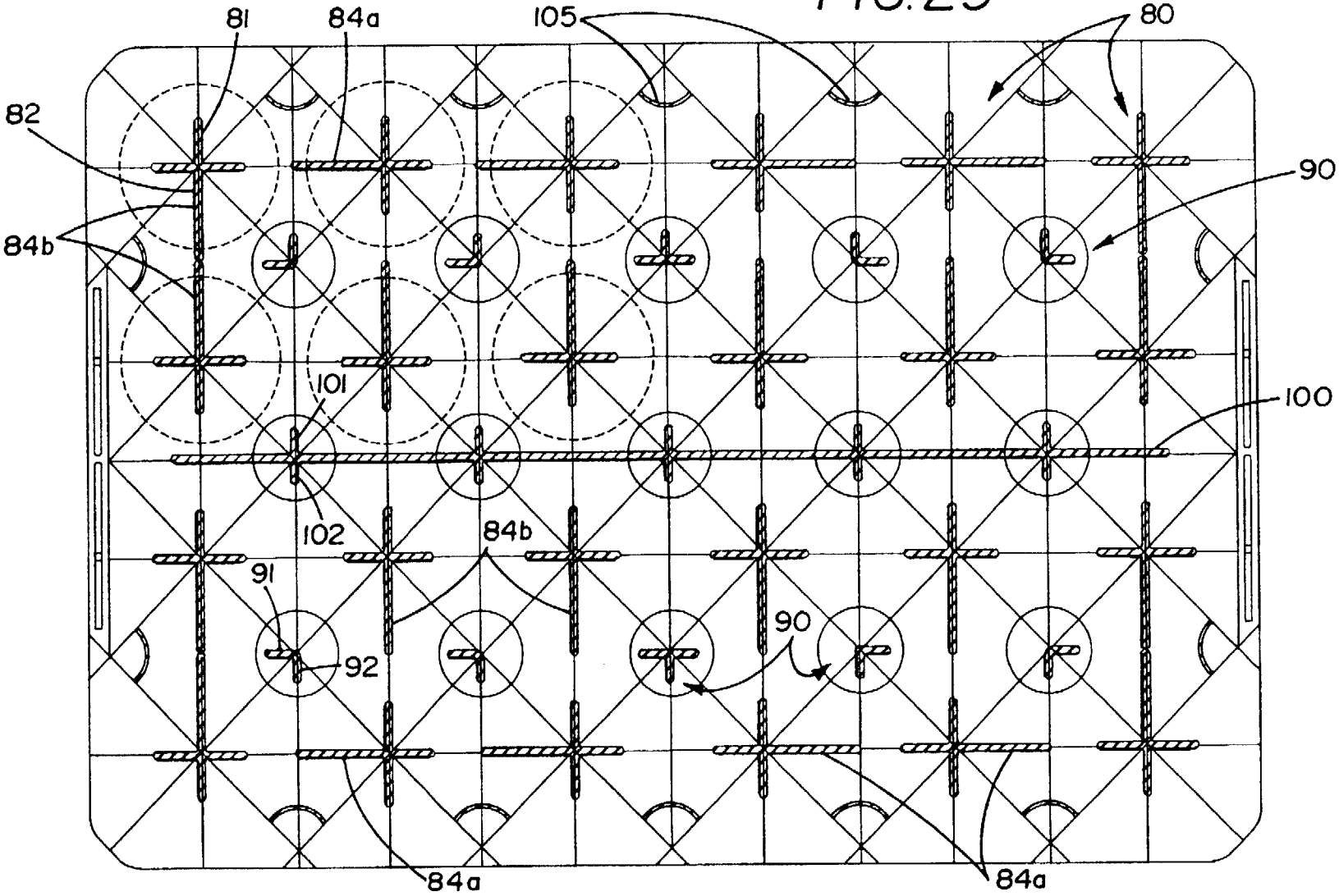
FIG. 29 is a schematic bottom plan view of the tray of the invention, showing the relationship between the redoubts on the bottom of the tray and the rims (shown in dot-and-dash lines) of cans in a sub-adjacent tray, when stacked in columnar relationship.

As seen in FIG. 29, the longer redoubt 84*a* in the redoubt sets extending along the opposite sides of the tray extend in a longitudinal direction parallel to the adjacent side, while the longer redoubt 84*b* in the redoubt sets spaced inwardly of the tray floor and along opposite ends of the tray extend in a direction transverse to the long dimension of the tray. The remaining redoubts are relatively short, and when centered relative to a can end lie within the space bounded by the rim of the can. This arrangement ensures that the long redoubt member will span the rim of a can in a sub-adjacent tray when the trays are stacked in columnar relationship, as well as when they are cross-stacked.

Downwardly projecting redoubt sets 90 are also formed on the underside of the laterally and longitudinally extending struts extending beneath the spacer members 21. These redoubt sets similarly comprise downward projections 91 and 92 intersecting one another at right angles at a point coinciding with the center of the respective spacer members. Except along the longitudinal centerline of the tray, these redoubts do not cross one another but instead intersect to form a "V" or "L" shaped configuration in plan view. These redoubts are oriented so that one leg thereof points longitudinally toward the adjacent end of the tray, and the other leg points transversely toward the adjacent long side of the tray, with the redoubts on opposite sides of the transverse centerline of the tray pointing in opposite directions toward the respective opposite ends of the tray.

A single, long, continuous redoubt or rib 100 is formed on the underside of the strut extending along the longitudinal centerline of the tray, defining a continuous, uninterrupted surface extending longitudinally of the tray. Relatively short, transversely extending redoubts 101 and 102 intersect this rib at points corresponding to the center of the spacer members lying along the longitudinal centerline of the tray.

Figure 30:
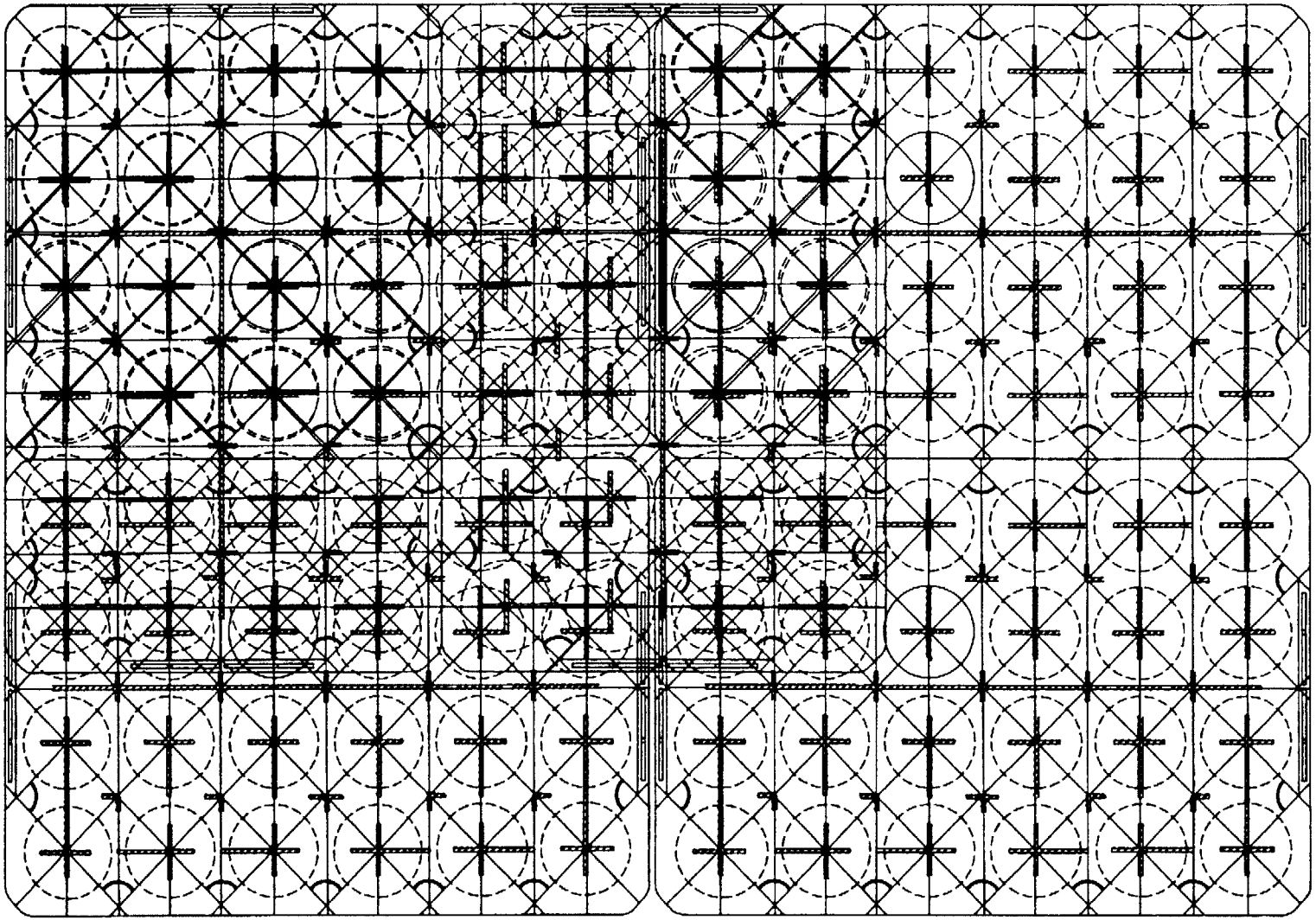
FIG. 30 is a schematic bottom plan view showing the relationship of the redoubts and can rim when the trays are cross-stacked.

Further, in one form of the invention the lower ends of the pillars extend downwardly to form arcuately shaped redoubts 105 around the outer periphery of the tray bottom. However, these redoubts 105 may be omitted, if desired, as seen in FIG. 30, for example.

With the exception of those redoubt sets 90 lying beneath the spacer members 21, the redoubts are recessed at 110 at their crossing points to avoid interference with the pull tab on sub-adjacent cans when loaded trays are columnar stacked on top of one another in columnar relationship.

The dimensions of the redoubts and their orientation as depicted in FIG. 29 are such that redoubts will be engaged with both the inner and outer sides of the rims of cans when the trays are stacked, with the exception of those redoubt members 84*a* and 84*b* which extend in spanning relationship to the rims of the cans to facilitate initial sliding movement of one tray over the tops of cans in a sub-adjacent tray.

The sidewall height in the tray of the invention is greater than the sidewall height of a conventional tray in order to improve the stability of cans in the tray when the tray is held at an angle. In conventional trays the sidewall height is only about 2 inches, or less, whereas in the present invention the sidewall height is approximately 50% greater, with the upper edge of the top rail being approximately 2⅞ inches above the floor of the tray. This height not only provides greater stability to cans in the tray when the tray is held at a steeply inclined angle, but at the same time leaves the UPC code visible on most major brands.

While particular embodiments of the invention have been illustrated and described in detail herein, it should be understood that various changes and modifications may be made to the invention without departing from the spirit and intent of the invention as defined by the scope of the appended claims.

What is claimed is:

1. A beverage can tray for holding a quantity of cans of beverage, said tray comprising:

a tray floor having a top surface and a bottom surface and a plurality of spaced apart can seating means distributed over the top surface for seating a plurality of cans in spaced apart relationship to one another;

said tray floor comprising a plurality of parallel, uniformly spaced apart, longitudinally and laterally extending orthogonally intersecting struts defining an open grid of rectangular configuration;

said can seating means are supported by said struts;

upstanding sidewall means extending upwardly from the floor top surface around the periphery of the floor for confining and stabilizing the cans supported on the floor;

multi-level redoubt means formed on the underside of said struts and projecting downwardly from the underside of the tray floor a predetermined depth for cooperation with the top rims in cans supported in a sub-adjacent tray when a plurality of trays containing cans of beverage are stacked on top of one another, to impede free sliding movement of one tray over the tops of cans in a sub-adjacent tray so that the trays can be stacked together in stable relationship, but at the same time enabling said one tray to be moved laterally with respect to the sub-adjacent tray, when desired, to remove said one tray from the stack of trays, said redoubt means including an elongate redoubt of tapered depth that spans the top rim of a can formed on the underside of said struts.

2. A beverage can tray as claimed in claim 1, wherein:

said redoubt means are formed at the intersections of said laterally and longitudinally extending struts and have predetermined lengths in directions parallel to the plane of the tray floor and predetermined depths in a direction perpendicular to the plane of the tray floor.

3. A beverage can tray as claimed in claim 2, wherein:

said redoubt means comprise a plurality of redoubt sets distributed over the bottom surface of the tray floor, with a redoubt set disposed beneath each can seating means and each redoubt set formed by a pair of elongate redoubts intersecting one another at a right angle, with the point of intersection being coincident with the center of the associated can seating means.

4. A beverage can tray as claimed in claim 3, wherein:

the can seating means each comprises a circular can seating ring having a tapered, frustoconical shape in transverse cross-section, said ring being supported on top of said laterally and longitudinally extending struts to define an uninterrupted frustoconical can seating surface which automatically centers the cans on the seating surface.

5. A beverage can tray as claimed in claim 4, wherein:

each redoubt set is substantially cross-shaped in plan view, with three legs of the cross having a length so as to lie within the area bounded by the circular can seating ring, and the fourth leg of the cross comprising the elongate redoubt of tapered depth, said elongate redoubt extending from inside the area bounded by the circular seating ring to outside the area and tapering from a greater depth inside the area to a lesser depth outside the area.

6. A beverage can tray as claimed in claim 5, wherein:

said redoubt means comprise first and second redoubt sets, said first redoubt sets comprising those lying beneath the can seating means, and the second redoubt sets are distributed across the bottom surface of the tray floor in locations spaced between the first redoubt sets, said redoubt sets being spaced and configured so that when a plurality of trays containing cans of beverage are stacked on top of one another the redoubts on a top tray engage both inside and outside the rims of cans in a sub-adjacent tray, with said elongate redoubt extending across the rim of an associated can from inside the space bounded by the rim to outside the space.

7. A beverage can tray as claimed in claim 6, wherein:

said second redoubt sets each comprises a pair of elongate redoubts intersecting one another at a right angle and defining a V-shape in plan view.

8. A beverage can tray as claimed in claim 7, wherein:

the outer ends of the legs of the cross-shaped redoubts in the first redoubt set and the outer ends of the legs of the V-shaped redoubts in the second redoubt set are tapered to facilitate movement of the redoubts over the rims of cans in a sub-adjacent tray when trays filled with cans of beverage are stacked on top of one another.

9. A beverage can tray as claimed in claim 8, wherein:

the sidewall means comprises a plurality of upright, spaced apart pillars extending from the periphery of the tray floor at their lower ends to an upper end spaced above the tray floor; and a band-like tray top rail is supported on the upper ends of the pillars, said top rail extending substantially continuously around the periphery of the tray and having a substantially smooth, flat, uninterrupted, vertical outer surface.

10. A beverage can tray as claimed in claim 9, wherein:

the lower ends of the pillars extend downwardly below the plane of the tray floor to define a third set of redoubts around the periphery of the tray floor.

11. A beverage can tray as claimed in claim 10, wherein:

the pillars each have an arcuately curved C-shape in transverse cross-section, and the redoubts on the lower ends thereof have a corresponding shape in plan view.

12. A beverage can tray as claimed in claim 3, wherein:

the point of intersection of said redoubts is recessed to provide clearance for the pull tab on cans in a sub-adjacent tray when trays loaded with cans are stacked on top of one another.

13. A beverage can tray for holding a quantity of cans of beverage, said tray comprising:

a tray floor having a top surface and a bottom surface and a plurality of spaced apart can seating means distributed over the top surface for seating a plurality of cans in spaced apart relationship to one another;

upstanding sidewall means extending upwardly from the floor top surface around the periphery of the floor for confining and stabilizing the cans supported on the floor;

multi-level redoubt means projecting downwardly from the underside of the tray floor a predetermined depth for cooperation with the top rims in cans supported in a sub-adjacent tray when a plurality of trays containing cans of beverage are stacked on top of one another, to impede free sliding movement of one tray over the tops of cans in a sub-adjacent tray so that the trays can be stacked together in stable relationship, but at the same time enabling said one tray to be moved laterally with respect to the sub-adjacent tray, when desired, to remove said one tray from the stack of trays, said redoubt means including an elongate redoubt of tapered death that spans the top rim of a can;

said redoubt means having predetermined lengths in directions parallel to the plane of the tray floor and predetermined depths in a direction perpendicular to the plane of the tray floor; and said redoubt means comprise a plurality of redoubt sets distributed over the bottom surface of the tray floor, each redoubt set being formed by a pair of elongate redoubts intersecting one another at a right angle, and with a first redoubt set disposed beneath each can seating means with the point of intersection of the redoubts in the first set being coincident with the center of the associated can seating means.

14. A beverage can tray as claimed in claim 13, wherein:

said redoubt sets comprise first and second redoubt sets, said first redoubt sets each comprising a pair of elongate redoubts intersecting one another at a right angle and defining a cross-shape in plan view, and said second redoubt sets each comprising a pair of elongate redoubts intersecting one another at a right angle and defining a V-shape in plan view, said second redoubt sets being distributed across the bottom surface of the tray floor in locations spaced between the first redoubt sets, said first and second redoubt sets being spaced and configured so that when a plurality of trays containing cans of beverage are stacked on top of one another the redoubts on a top tray engage both inside and outside the rims of cans in a sub-adjacent tray, with said elongate redoubt extending across the rim of an associated can from inside the space bounded by the rim to outside the space.

15. A beverage can tray as claimed in claim 14, wherein:

the outer ends of the legs of the cross-shaped redoubts in the first redoubt set and the outer ends of the legs of the V-shaped redoubts in the second redoubt set are tapered to facilitate movement of the redoubts over the rims of cans in a sub-adjacent tray when trays filled with cans of beverage are stacked on top of one another.

16. A beverage can tray as claimed in claim 15, wherein:

said elongate redoubt tapers from a first, greater depth adjacent its point of intersection with the other redoubts in that set, to a second, lesser depth at its outer end remote from the point of intersection, defining an elongate tapered ramp to facilitate movement over the rims of cans in a sub-adjacent tray.

17. A beverage can tray for holding a quantity of cans of beverage, said tray comprising:

a tray floor having a top surface and a bottom surface and a plurality of spaced apart can seating areas distributed over the top surface for seating a plurality of cans in spaced apart relationship to one another:

upstanding sidewall means extending upwardly from the floor top surface around the periphery of the floor for confining and stabilizing the cans supported on the floor;

a plurality of upwardly projecting spacer members distributed over the floor top surface in locations spaced between the can seating areas to extend between cans supported on the tray and maintain the cans in spaced relationship to one another and to prevent displacement of the cans across the tray floor when the tray is tilted;

said tray floor including a plurality of parallel, uniformly spaced apart, longitudinally and laterally extending orthogonally intersecting struts defining an open grid of rectangular configuration;

the can seating areas being circular in plan view and supported on said struts; and said spacer members are hollow, frustoconically shaped members supported on said struts in uniformly spaced relationship between the circular can seating areas.

18. A beverage can tray as claimed in claim 17, wherein:

multi-level redoubt means project downwardly from the underside of the tray floor a predetermined depth for cooperation with the top rims in cans supported in a sub-adjacent tray when a plurality of trays containing cans of beverage are stacked on top of one another, to impede free sliding movement of one tray over the tops of cans in a sub-adjacent tray so that the trays can be stacked together in stable relationship, but at the same time enabling said one tray to be moved laterally with respect to the sub-adjacent tray, when desired, to remove said one tray from the stack of trays, said redoubt means including an elongate redoubt of tapered depth that spans the top rim of a can, said redoubts being formed on the underside of the struts.

19. A beverage can tray as claimed in claim 18, wherein:

said redoubt means are formed at the intersections of said laterally and longitudinally extending struts and have predetermined lengths in directions parallel to the plane of the tray floor and predetermined depths in a direction perpendicular to the plane of the tray floor.

20. A beverage can tray as claimed in claim 19, wherein:

said redoubt means comprise a plurality of redoubt sets distributed over the bottom surface of the tray floor, with a redoubt set disposed beneath each can seating means and each redoubt set formed by a pair of elongate redoubts intersecting one another at a right angle, with the point of intersection being coincident with the center of the associated can seating means.

21. A beverage can tray as claimed in claim 20, wherein:

the sidewall means comprises a plurality of upright, spaced apart pillars extending from the periphery of the tray floor at their lower ends to an upper end spaced above the tray floor; and a band-like tray top rail is supported on the upper ends of the pillars, said top rail extending substantially continuously around the periphery of the tray and having a substantially smooth, flat, uninterrupted, vertical outer surface.

22. A beverage can tray as claimed in claim 21, wherein:

heel protector means extend between the pillars at their lower ends, in upwardly spaced relationship to the floor, to protect the heels of cans supported in the tray from damage due to contact with means outside the tray, said heel protector means comprising relatively narrow upstanding bands.

23. A beverage can tray as claimed in claim 22, wherein:

said heel protector bands are arcuately shaped and are concentric with adjacent circular can seating areas in radially outwardly spaced relationship therefrom; and said pillars each has an arcuate, C-shaped transverse cross-section, forming a continuous, smoothly contoured serpentine configuration with said heel protector bands.

24. A beverage can tray as claimed in claim 23, wherein:

a bottom outer surface of said heel protector bands and said pillars is downwardly and inwardly tapered to facilitate insertion of a lifting implement under the tray.

25. A beverage can tray for holding a quantity of cans of beverage, said tray comprising:

a tray floor having a top surface and a bottom surface and a plurality of spaced apart can seating areas distributed over the top surface for seating a plurality of cans in spaced apart relationship to one another;

upstanding sidewall means extending upwardly from the floor top surface around the periphery of the floor for confining and stabilizing the cans supported on the floor, said sidewall means comprising a plurality of upright, spaced apart pillars extending from the periphery of the tray floor at their lower ends to an upper end spaced above the tray floor, and a band-like tray top rail supported on the upper ends of the pillars, said top rail extending substantially continuously around the periphery of the tray, a space being defined between at least some of said pillars and an adjacent portion of said top rail where said at least some of said pillars and said top rail intersect; and a tab projecting upwardly from at least some of said pillars beyond a top edge of said top rail, said tab adapted to extend into said space when a plurality of trays are stacked together in nested relationship with one another, preventing wedging and shingling of said trays and stabilizing said stack.

26. A beverage can tray as claimed in claim 25, wherein:

an upwardly and outwardly angled web is formed between said top rail and said pillars on a surface of said pillars facing outwardly relative to said tray, said webs serving to prevent shingling of said trays when they are stacked together.

27. A beverage can tray as claimed in claim 26, wherein:

angled notches are formed in a top edge of said top rail in positions to coincide with the angled webs so that when said trays are nested together the webs rest in said notches, thereby enabling deeper nesting of the trays.

28. A beverage can tray for holding a quantity of cans of beverage, said tray comprising:

a tray floor having a top surface and a bottom surface and a plurality of spaced apart can seating means distributed over the top surface for seating a plurality of cans in spaced apart relationship to one another;

upstanding sidewall means extending upwardly from the floor top surface around the periphery of the floor for confining and stabilizing the cans supported on the floor; and multi-level redoubt means projecting downwardly from the underside of the tray floor a predetermined depth for cooperation with the top rims in cans supported in a sub-adjacent tray when a plurality of trays containing cans of beverage are stacked on top of one another, to impede free sliding movement of one tray over the tops of cans in a sub-adjacent tray so that the trays can be stacked together in stable relationship, but at the same time enabling said one tray to be moved laterally with respect to the sub-adjacent tray, when desired, to remove said one tray from the stack of trays, said redoubt means including an elongate redoubt of tapered depth that spans the top rim of a can in a sub-adjacent tray when the trays are in normally stacked blocked relationship to one another, said elongate tapered redoubt facilitating initial lateral movement of said one tray over the tops of cans in a sub-adjacent tray.

29. A beverage can tray as claimed in claim 28, wherein:

said tray floor comprises a plurality of parallel, uniformly spaced apart, longitudinally and laterally extending orthogonally intersecting struts defining an open grid of rectangular configuration;

said can seating means are supported by said struts; and said redoubt means are formed on the underside of said struts.

30. A beverage can tray as claimed in claim 28, wherein:

said redoubt means comprise a plurality of redoubt sets, each redoubt set is substantially cross-shaped in plan view, with three legs of the cross having a length so as to lie within the area bounded by the circular can seating ring, and the fourth leg of the cross comprises the elongate redoubt of tapered depth, said elongate redoubt extending from inside the area bounded by the circular seating ring to outside the area and tapering from a greater depth inside the area to a lesser depth outside the area.

31. A beverage can tray as claimed in claim 28, wherein:

said redoubt means comprise first and second redoubt sets, said first redoubt sets comprising those lying beneath the can seating means, and the second redoubt sets are distributed across the bottom surface of the tray floor in locations spaced between the first redoubt sets, said redoubt sets being spaced and configured so that when a plurality of trays containing cans of beverage are stacked on top of one another the redoubts on a top tray engage both inside and outside the rims of cans in a sub-adjacent tray, with said elongate redoubt extending across the rim of an associated can from inside the space bounded by the rim to outside the space.

32. A beverage can tray as claimed in claim 31, wherein:

the sidewall means comprises a plurality of upright, spaced apart pillars extending from the periphery of the tray floor at their lower ends to an upper end spaced above the tray floor; and the lower ends of the pillars extend downwardly below the plane of the tray floor to define a third set of redoubts around the periphery of the tray floor.

33. A beverage can tray as claimed in claim 28, wherein:

the sidewall means comprises a plurality of upright, spaced apart pillars extending from the periphery of the tray floor at their lower ends to an upper end spaced above the tray floor; and a band-like tray top rail is supported on the upper ends of the pillars, said top rail extending substantially continuously around the periphery of the tray and having a substantially smooth, flat, uninterrupted, vertical outer surface.

34. A beverage can tray for holding a quantity of cans of beverage, said tray comprising:

a tray floor having a top surface and a bottom surface and a plurality of spaced apart can seating means distributed over the top surface for seating a plurality of cans in spaced apart relationship to one another;

upstanding sidewall means extending upwardly from the floor top surface around the periphery of the floor for confining and stabilizing the cans supported on the floor; and the sidewall means comprises a plurality of upright, spaced apart pillars extending from the periphery of the tray floor at their lower ends to an upper end spaced above the tray floor;

the lower ends of the pillars extend downwardly below the plane of the tray floor to define redoubts around the periphery of the tray floor; and multi-level redoubt means projecting downwardly from the underside of the tray floor a predetermined depth for cooperation with the top rims in cans supported in a sub-adjacent tray when a plurality of trays containing cans of beverage are stacked on top of one another, to impede free sliding movement of one tray over the tops of cans in a sub-adjacent tray so that the trays can be stacked together in stable relationship, but at the same time enabling said one tray to be moved laterally with respect to the sub-adjacent tray, when desired, to remove said one tray from the stack of trays, said redoubt means including an elongate redoubt of tapered depth that spans the top rim of a can.

* * * * *